US005138745A

United States Patent [19]

Rentschler

[11] Patent Number: 5,138,745

[45] Date of Patent: Aug. 18, 1992

[54] ROD RETAINING SLEEVE

[75] Inventor: William J. Rentschler, Dothan, Ala.

[73] Assignee: Dunbarton Corporation, Dothan, Ala.

[21] Appl. No.: 587,682

[22] Filed: Sep. 25, 1990

[51] Int. Cl.[5] ..... E05D 5/12

[52] U.S. Cl. ..... 16/380; 160/118; 160/206

[58] Field of Search ..... 16/380, 87.2, 87.4 R, 16/90, 100, 379; 160/118, 199, 206

[56] References Cited

U.S. PATENT DOCUMENTS

| | | | |
|---|---|---|---|
| Re. 31,553 | 4/1984 | Ford et al. . | |
| 1,230,345 | 6/1917 | Urson . | |
| 1,245,042 | 10/1917 | Schoening . | |
| 1,491,204 | 4/1924 | Epting | 16/100 |
| 1,503,328 | 7/1924 | McAllister | 16/100 |
| 1,612,499 | 12/1926 | Etheredge . | |
| 1,693,920 | 12/1928 | Hartmann | 16/19 |
| 2,181,101 | 11/1939 | Spenard . | |
| 2,804,136 | 8/1957 | Ternes et al. . | |
| 2,898,987 | 8/1959 | Ford . | |
| 2,943,675 | 7/1960 | Ford . | |
| 3,019,836 | 2/1962 | Leigh | 160/199 |
| 3,054,447 | 9/1962 | Brydolf . | |
| 3,152,356 | 10/1964 | Parsons | 16/380 |
| 3,160,201 | 12/1964 | Johnson . | |
| 3,162,890 | 12/1964 | Brydolf . | |
| 3,170,506 | 2/1975 | Johnson . | |
| 3,187,800 | 6/1965 | Kirby . | |
| 3,191,214 | 6/1965 | Protzman . | |
| 3,221,804 | 12/1965 | Rudnick . | |
| 3,233,657 | 2/1966 | Kirby . | |
| 3,285,324 | 11/1966 | Stein et al. . | |
| 3,302,691 | 2/1967 | Andrews . | |
| 3,368,236 | 2/1968 | Kirby . | |
| 3,372,689 | 3/1968 | Goudy . | |
| 3,390,418 | 7/1968 | Sheridan | 160/206 |
| 3,391,723 | 7/1968 | Kirby . | |
| 3,511,300 | 5/1970 | Matyas . | |
| 3,514,805 | 6/1970 | Foltz . | |
| 3,554,267 | 1/1971 | Brinker . | |
| 3,584,332 | 6/1971 | Taylor . | |
| 3,592,257 | 7/1971 | Matyas . | |
| 4,095,310 | 6/1978 | Governale . | |
| 4,135,273 | 1/1979 | Holmes | 16/319 |
| 4,359,080 | 11/1982 | Brydolf | 160/206 |

FOREIGN PATENT DOCUMENTS

| | | |
|---|---|---|
| 1559966 | 1/1970 | Fed. Rep. of Germany . |
| 8608970.6 | 6/1986 | Fed. Rep. of Germany . |
| 1067937 | 5/1967 | United Kingdom . |
| 1145095 | 3/1969 | United Kingdom . |

OTHER PUBLICATIONS

Roberts-Fold ® installation procedure brochure discloses a folding door having a guide rod slidably received within a nylon sleeve 5113-610, (undated).

*Primary Examiner*—Lowell A. Larson
*Assistant Examiner*—Thomas C. Schoeffler
*Attorney, Agent, or Firm*—Jones, Askew & Lunsford

[57] ABSTRACT

Pivot and guide rod assembly for bi-fold door includes plastic sleeve for mounting in door channel and supporting a pivot rod. A spring is arranged to urge the pivot rod outwardly from the sleeve, a tang latch being provided on the sleeve for retaining the sleeve in the channel, and a groove defined on the pivot rod to engage an inwardly swedged portion of the plastic sleeve to retain the pivot rod in a retracted position during shipping and mounting of the door.

2 Claims, 2 Drawing Sheets

ROD RETAINING SLEEVE

TECHNICAL FIELD

This invention relates to metal bi-fold doors and more particularly relates to a pivot and guide rod assembly for use with such metal bi-fold doors.

BACKGROUND ART

Bi-folding doors are widely used for enclosing openings for closets and cabinets. Various fitting arrangements utilizing pivot and guide rod assemblies have been provided for supporting the doors in the opening and guiding them during their opening and closing movement. Some of the prior arrangements have been disadvantageous because they are difficult to assemble and adjust, and more importantly are expensive and space consuming to ship when installed in a folding door.

To conserve shipping space, it has been the practice to secure the pivot and guide rod assembly in a retracted position. This practice also protects the assembly against damage. Once the door is installed, it is necessary that the rod assembly be released to permit the rod to engage a guide channel mounted to the opening which defines the range of movement of the door.

An example of a pivot and guide rod assembly which is designed to meet these needs is disclosed in U.S. Re. Pat. No. 31,553. This self-contained rod was a major advance over the prior multiple piece pivot rods. Further improvements, however, were contemplated with respect to the cost of molding the latch, the appearance and the durability of that rod assembly.

Another example of a guide and pivot rod assembly is shown in U.S. Pat. No. 4,095,310. This assembly features a retractable pin and a locking tang for holding the assembly in the door frame. The pivot rod is held in the retracted position by a lug attached to the rod, which lug passes through an opening in the end wall of the housing of the assembly. In the retracted position the rod is rotated to lock the lug against the end wall of the housing. To extend the pivot rod into its extended position, it is necessary to re-rotate the rod to align the lug with the opening in the end wall before passing the lug back through the opening. This construction is inconvenient because the lug and opening are not visible to the installer and must be blindly aligned by the installer in a hit-or-miss fashion.

Other examples of pivot and guide rod assemblies which utilize yieldably positioned rods received within a plastic sleeve are known in the art. Three such assemblies being shown in U.S. Pat. No. 3,233,657; U.S. Pat. No. 3,511,300; and U.S. Pat. No. 3,592,257. These assemblies, however, do not provide for shipment of the pins in a retracted position.

SUMMARY OF THE INVENTION

It is an object of the present invention to provide a pivot assembly for mounting bi-fold doors that provides the several enhancements mentioned above.

More particularly, the present invention is concerned with a pivot and guide rod assembly for use with a bi-fold door which door has a formed metal face sheet and a stiffening channel secured along an edge of the sheet. The pivot and guide rod assembly of the present invention comprises an elongated plastic sleeve extending through openings in the flanges of the stiffening channel. The elongated sleeve has a resilient tang latch positioned to engage the channel to retain the sleeve therein and restrain the sleeve from upward movement within the channel. A pivot rod, which includes a shank portion, is positioned within the sleeve and slides longitudinally therein. The pivot rod has an enlarged head and a compression spring that is operatively arranged between the head portion of the rod and an end of the sleeve for urging the head portion away from the sleeve. An annular grooved portion is provided on the shank of the pivot rod for engaging an inwardly swedged portion of the sleeve for retaining the head portion in a retracted position adjacent the sleeve. The swedged portion is adapted to easily disengage the groove to permit the release of the head portion and thus allowing the pivot rod to be pushed partially outward of the sleeve. In the outward position the head portion is adapted to engage within a socket or track as selected so as to retain the door in operative position.

Thus, it is an object of the present invention to provide an improved pivot and guide rod assembly for bi-fold doors.

It is a further object of the present invention to provide a pivot and guide rod assembly which is economical to manufacture, aesthetically pleasing, and which is able to withstand repeated retraction and extension.

Yet another object of the present invention is to provide a pivot and guide rod assembly which is simple to assemble and adjust.

DETAILED DESCRIPTION OF A PREFERRED EMBODIMENT

The invention is concerned with an improved construction of bi-fold or folding door construction such as is shown in U.S. Pat. Nos. 2,898,987 and 2,943,675, and is more particularly concerned with an improvement over the pivot and guide rod assembly shown in U.S. Pat. No. Re. 31,553. Doors of this nature comprise a pair of door sections which are pivotally secured at the left and right hand sides of a closet opening or doorway. Each door section comprises a pair of panels, an outside panel which is vertically pivoted adjacent one side of the closet opening, and an inside panel which is pivotally connected to the outside panel. Each door functions to open and close one half the closet opening. Guide means, operatively constrained within an upper or lower track, or both, serve as pivot support for the outside panel and as a guide for the inside panel of the door units when in their opening and closing movements. Because this general construction is well known and is shown in the prior art including such patents, only the particular details of the improved door construction of the present invention are illustrated herein.

Figure 1:
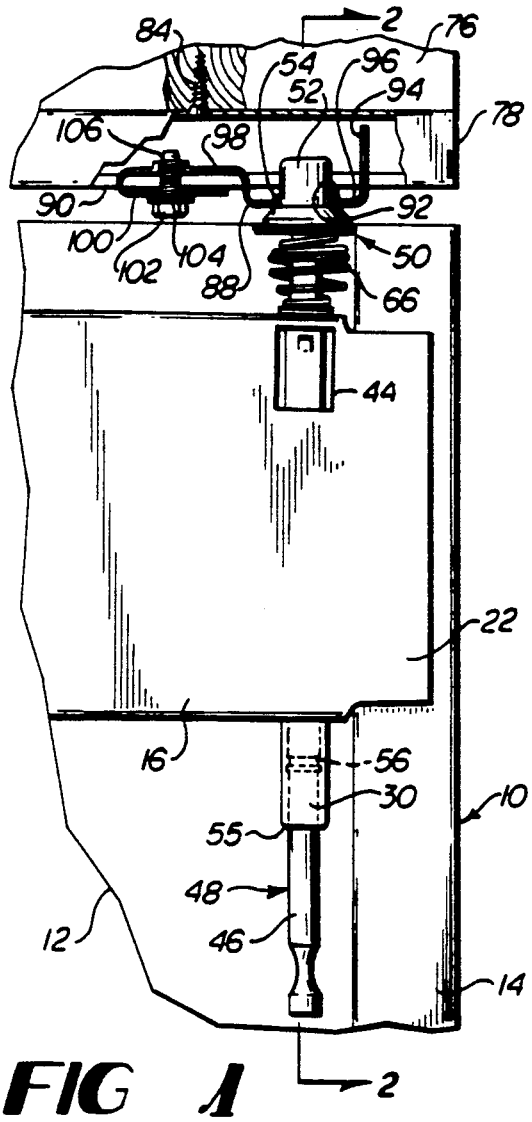
FIG. 1 is an enlarged sectional view through a guide rod assembly and a portion of a door illustrating the guide rod assembly in its extended position after installation of a door.
Figure 2:
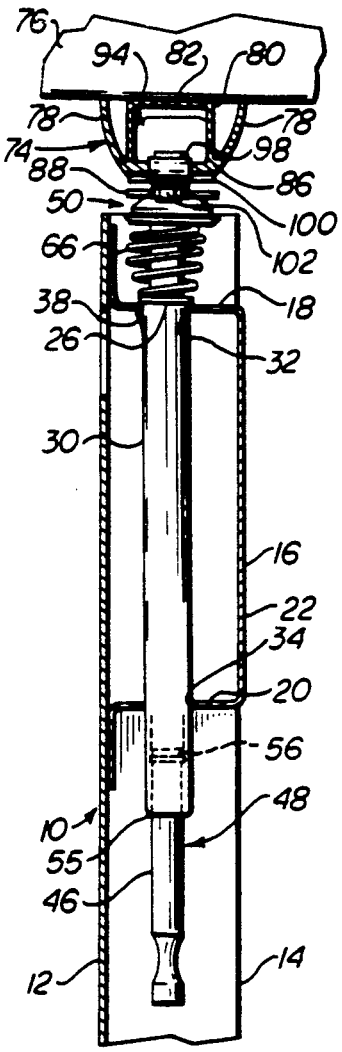
FIG. 2 is an elevational view taken along line 2—2 of FIG. 1 showing the guide rod assembly in its extended, operative position.
Figure 3:
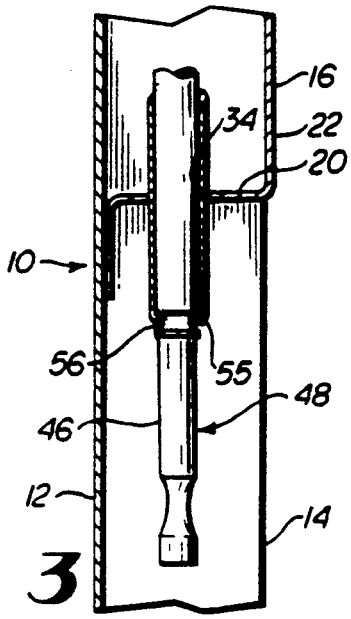
FIG. 3 is a sectional view showing the rod assembly in its retracted position.

Illustrated in FIGS. 1 and 2 is a portion of an outside panel 10 of such a door which is fabricated of sheet steel and which includes a face sheet 12 the vertical edges of which are formed to provide channels 14 along the vertical edges. Along the top and bottom of each panel, additional stiffening is provided in the form of transverse hat sections or stiffening channels 16 which comprise flanges 18 and 20 extending substantially vertically outwardly from the surface of the face sheet 12 and a connecting web 22. The channels 16 are suitably secured as by welding to the face sheet 12.

Figure 4:
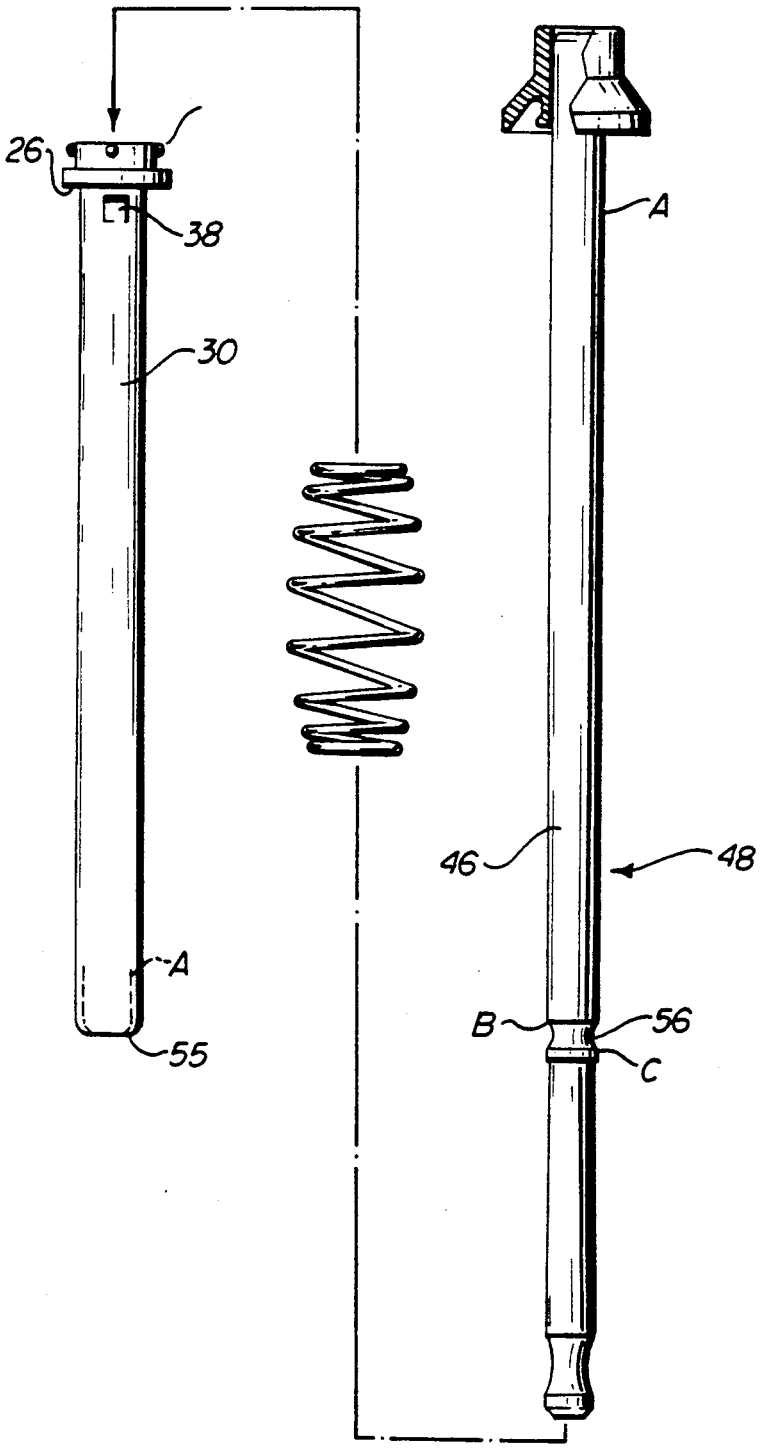
FIG. 4 is an exploded view showing the rod retaining sleeve and the guide rod.

The pivot assembly of the invention comprises an elongated plastic sleeve 30, shown in FIG. 4, of nylon or other suitable material which extends through cooperating openings 32, 34 in the flanges 18, 20, respectively. Formed on the upper end of the sleeve is an integral collar 26 which abuts the outer surface of the flange 18 adjacent the upper edge of the panel 10. A resilient tang latch 38, positioned just beneath the collar, extends upwardly and outwardly from the sleeve 30 and engages the uppermost portion of the channel 16 to retain the sleeve in the channel. The sleeve is mounted in the channel by sliding the sleeve through the openings 32, 34. The tang latch 38 depresses as it passes through the opening 32 and, because of its resiliency, returns to its original inclination and resists upward passage through the opening 32 thereby retaining the sleeve 30 within the channel 16. The sleeve, however, may be released from the channel by manually depressing the tang latch 38 to allow the tang latch to pass upwardly through the opening 32. Access to the latch 38 is provided through opening 44, shown in FIG. 1.

Referring to FIG. 4, the sleeve 30 is adapted to receive shank portion 46 of a pivot or guide rod 48. The pivot rod shank 46 is of such diameter that it may slide longitudinally within the sleeve 30. The upper end of the pivot or guide rod 48 is provided with an enlarged head portion 50, FIG. 1, which may be of nylon or other suitable plastic firmly secured as by a press fit to the end of the shank 46. The head portion 50 comprises an upper cylindrical pivot head 52 adapted to be received within a suitable socket 54 positioned within track 74. Also defined on the lowermost end of the sleeve 30 is an inwardly swedged portion 55. The inwardly swedged portion 55 is positioned to engage an annular groove 56 defined on the rod, when the pivot rod is retracted within the sleeve such that the head 50 and the collar 26 are in abutting relationship.

Referring further to FIG. 4, the outer diameter of the guide rod is preferably 0.25 inch between points A and B, 0.21 inch within the groove 56, and 0.25 inch for section C. The inner diameter of the sleeve is preferably 0.26 inch except at point D, where it swedges down to 0.23 inch. These dimensions allow the swedged portion 55 of the sleeve 30 to lock within the groove 56 when the guide rod is retracted for shipping, yet allows the sleeve to move freely without excessive lateral movement or wiggle when the guide rod is in operation. It will be understood however, that other dimensions which provide the same effect may be used.

Means are provided to urge the pivot rod 48 upwardly or outwardly with respect to the sleeve 30. Such means comprises a compression spring 66, the lower end of which surrounds the upper end of the sleeve 30 immediately above the collar 26 and is removably retained thereon by a plurality of projections 70 each extending outwardly from the surface of the sleeve to engage the lower turn of the spring. The upper end of the spring 66 surrounds the lower end 71 of the head portion 50 which is likewise provided with a plurality of projections 72 to releasably engage a portion of the spring.

The pivot socket 54 may be suitably mounted in any manner within the track 74 suitably secured to the door frame or header 76. The illustrated track 74 comprises a shaped or formed metal member including opposite arch-shaped side walls 78 and an inner channel 80 of rectangular cross section. The bottom wall 82 of the channel 80 abuts against the header 76 and the track is suitably secured to the header, such as by screws 84. The track is formed with a pair of opposite lips 86 projecting inwardly from the opposite sides of the track.

Referring further to FIGS. 1 and 2 in the illustrated embodiment the pivot socket 54 is a stamped and formed metal member including a flat plate portion 88 adapted to bridge the opposite bottom edges 90 of the track 74 and having an extruded hole 92 therein for receiving the pivot rod head 52. A flange 94 extends upwardly from one end of the plate portion 88 and which flange is shaped to fit snugly within channel 80, the flange 94 being connected to the plate portion by a neck 96. The pivot socket 54 is clamped in place by a clamping portion including a top part 98 adapted to engage the upper edges of lips 86 and bottom part 100 adapted to engage the lower edges 90 of the track, the metal member being reversely curved to position the bottom part 100 beneath the top part 98. A screw 102 extends upwardly through hole 104 in the bottom part 100 and is threadably received in a cooperatively threaded opening 106 in the top part 98, whereby tightening of the screw 102 effects clamping of the parts 98, 100 against the respective track surfaces to fit the position of the pivot socket 54 in the track.

To assemble the pivot rod assembly in a door, the spring 66 and pivot rod 48 are assembled, the pivot rod is inserted into the sleeve 30 and the spring depressed until the swedged portion 55 of the sleeve engages the grooved 56 on the rod. The sleeve 30 is then inserted through the flange openings 32, 34 until tang latch 38 passes into the channel 16. Once the tang latch 38 passes into the channel, the tang latch pops up to restrain the sleeve within the channel 16. This assembly just described can be done at the factory or at the job site. It will be apparent that the sleeve can be easily removed from the door, in the event that it is desired to change the door or for other reasons, by accessing the tang latch 38 through opening 44 and manually depressing the tang latch, thereby allowing the sleeve to be removed. Because of the resiliency of the tang latch, however, the tang latch is unharmed by this action and returns to its original configuration so that it may be removed and installed repeatedly.

When a door is positioned in the door opening and the pivot head 52 is positioned beneath the socket 54, the installer needs simply apply upward pressure to the lower end of the pivot rod to disengage the swedged portion 55 of the sleeve from the annular groove 56 of the rod where upon the spring 66 will push the pivot rod upwardly so that the pivot head 52 engages within the socket 54. The spring 66 will keep the pivot head engaged within the socket of the door and, of course, accommodates the door to openings of various heights.

The assembly of the present invention provides an assembly having restraining means entirely within the channel 16, and thus obviates the need for restraining components which extend outside the channel. This provides a guide rod assembly having improved aesthetic qualities and reduced complexity of the mold required to mold the sleeve. A less complex mold allows for lower fabricating costs and reduces waste caused by imperfect moldings, because of the ease of molding.

Having illustrated and described a preferred embodiment of the invention, it should be apparent that it permits of modification and arrangement and detail.

I claim:

1. In a metal door assembly comprising a door panel comprising a face sheet, a stiffening channel secured to one surface of said sheet along an edge thereof, said channel having a pair of spaced apart flanges extending outwardly from said surface and a connecting web, and a pivot rod and guide assembly mounted in said channel, said assembly comprising:

a. an elongated plastic sleeve extending through corresponding openings in said flanges, said sleeve comprising:
   i. a collar on said sleeve,
   ii. an inwardly swedged portion defined on said sleeve; and
   iii. a resilient tang latch extending outwardly from said sleeve for restraining said sleeve from movement within said channel, b. a pivot rod comprising:
   i. a shank portion positioned in said sleeve and slidable therein;
   ii. an enlarged head; and
   iii. a groove in said shank and positioned to frictionally engage said inwardly swedged portion of said sleeve for releasably retaining said head in a retracted position adjacent said collar, c. a compression spring operatively arranged between said sleeve and said pivot rod for urging said pivot rod outwardly from said sleeve.

2. A pivot and guide rod assembly for mounting within a channel of a metal door comprising:

a. an elongated plastic sleeve comprising;
   i. a collar on said sleeve;
   ii. an inwardly swedged portion defined on said sleeve; and
   iii. a resilient tang latch extending upwardly and outwardly from said sleeve for restraining said sleeve from upward movement within said channel, b. a pivot rod comprising:
   i. a shank portion positioned in said sleeve and slidable therein;
   ii. an enlarged head; and
   iii. a groove defined on said shank and positioned to frictionally engage said inwardly swedged portion of said sleeve for releasably retaining said head in a retracted position adjacent said collar, and c. compression spring operatively arranged between said sleeve and said pivot rod for urging said pivot rod outwardly from said sleeve.

* * * * *